United States Patent [19]

Jubenville et al.

[11] 4,311,157

[45] Jan. 19, 1982

[54] SONIC TREATING APPARATUS

[75] Inventors: Duncan B. Jubenville, Windsor, Canada; Melvin G. DeGrazia, Jr., Farmington Hills, Mich.

[73] Assignee: Rock Oil Corporation, Detroit, Mich.

[21] Appl. No.: 124,812

[22] Filed: Feb. 26, 1980

[51] Int. Cl.[3] ..... B08B 3/12

[52] U.S. Cl. ..... 134/125; 134/127; 134/130; 134/155; 134/184

[58] Field of Search ..... 134/1, 64 R, 64 P, 74–75, 134/83, 122 R, 122 P, 124–127, 130, 155, 184

[56] References Cited

U.S. PATENT DOCUMENTS

| | | | |
|---|---|---|---|
| 2,702,260 | 2/1955 | Massa | 134/184 X |
| 2,784,119 | 3/1957 | McCown et al. | 134/184 X |
| 2,913,973 | 11/1959 | Bull et al. | 134/122 P |
| 3,635,762 | 1/1972 | Ott et al. | 134/64 R X |
| 3,871,982 | 3/1975 | Idstein | 134/64 R X |
| 3,968,013 | 7/1976 | Boynton | 134/83 X |
| 4,057,070 | 11/1977 | van Amerongen et al. | 134/184 X |
| 4,140,383 | 2/1979 | Schmidt | 134/64 P X |

*Primary Examiner*—Robert L. Bleutge
*Attorney, Agent, or Firm*—Hugh Adam Kirk

[57] ABSTRACT

A sonic treating apparatus in which sheet material is immersed in a shallow tank between sonic treating vibrators along opposite parallel sides thereof, which vibrators produce a horizontally sonic vibrating treating liquid in the tank. The sheets to be treated are supported with their planes horizontal and conveyed in this horizontal plane through the treating liquid transversely of its sonic vibrations so that two opposite edges of the horizontal sheets pass along and adjacent to the sonic vibrators. The conveyor may comprise a treating-liquid-resistant sprocket chain conveyor upon which the sheets rest. The sonic vibrators vibrate at a preset frequency between about 18 and 50 kilohertz and preferably between about 20 and 27 kilohertz. The treating liquid usually is for cleaning the sheets and may be an acid pickling solution for steel or phosphate coating solution, and the solution may be maintained at a predetermined elevated temperature by circulation through a heat exchanger. The temperature of the treating liquid, the concentration of the treating liquid, and the duration of the treatment are interdependent and are materially reduced from the conditions normally employed for such treatments without sonic vibrations.

18 Claims, 4 Drawing Figures

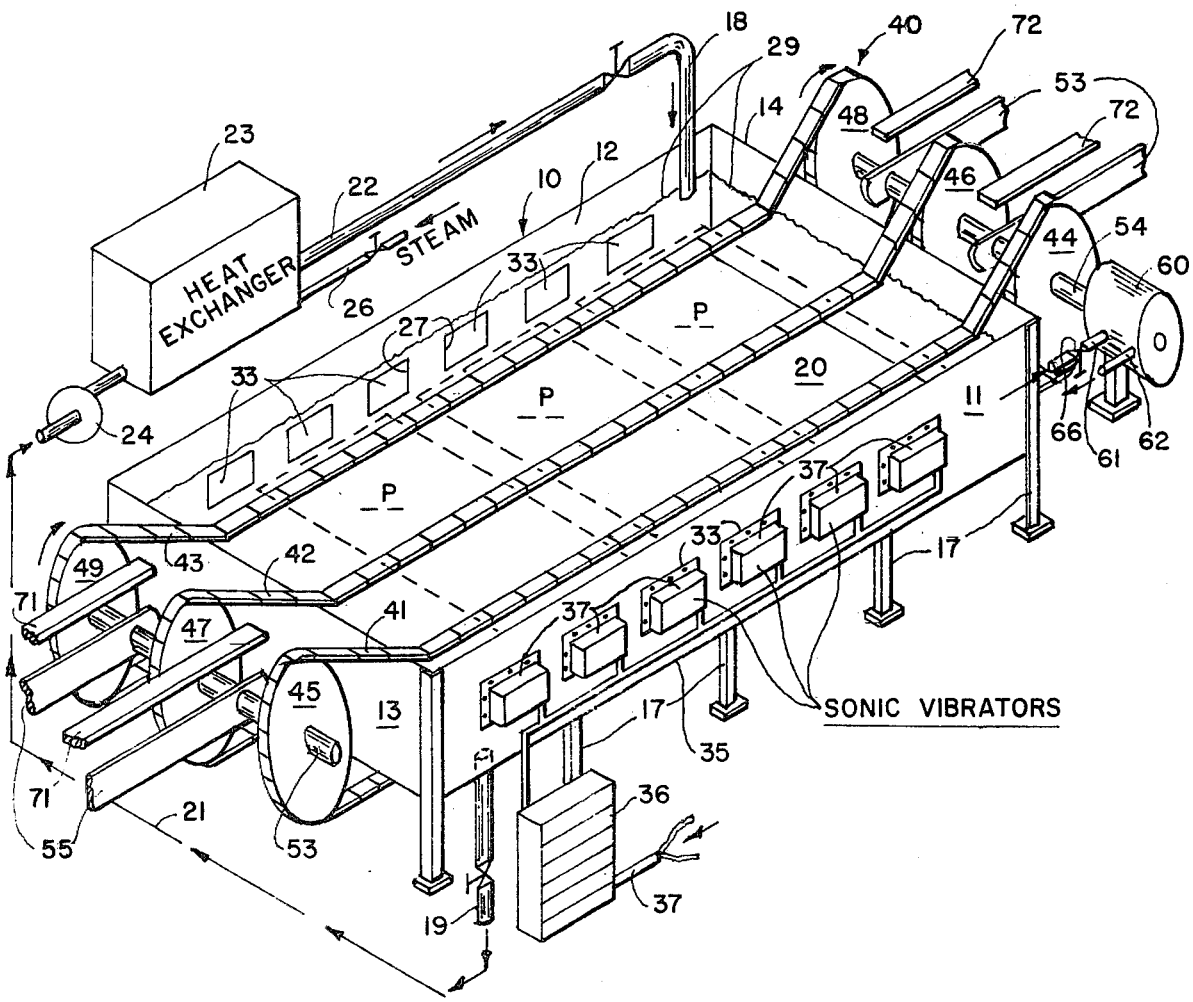
FIG. I

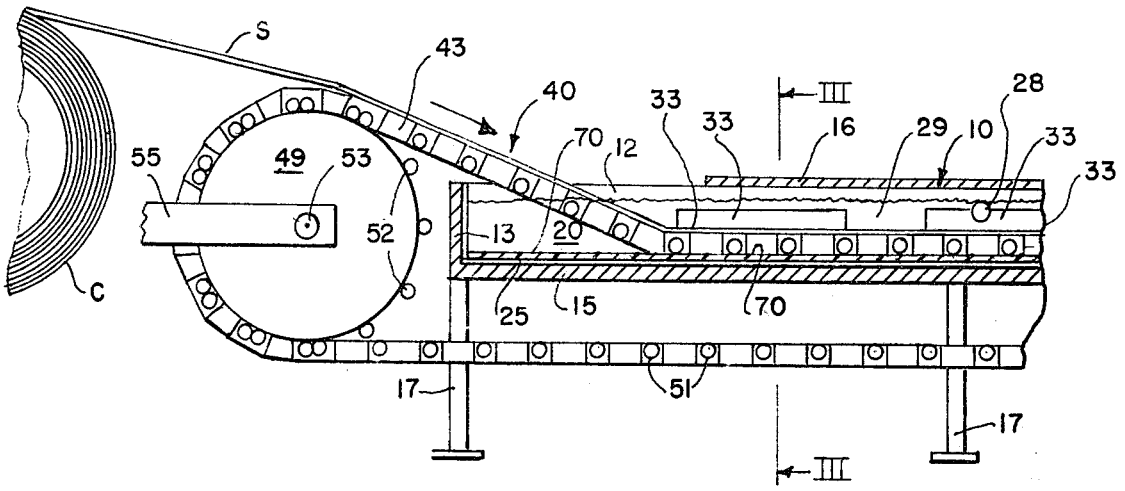
FIG. II
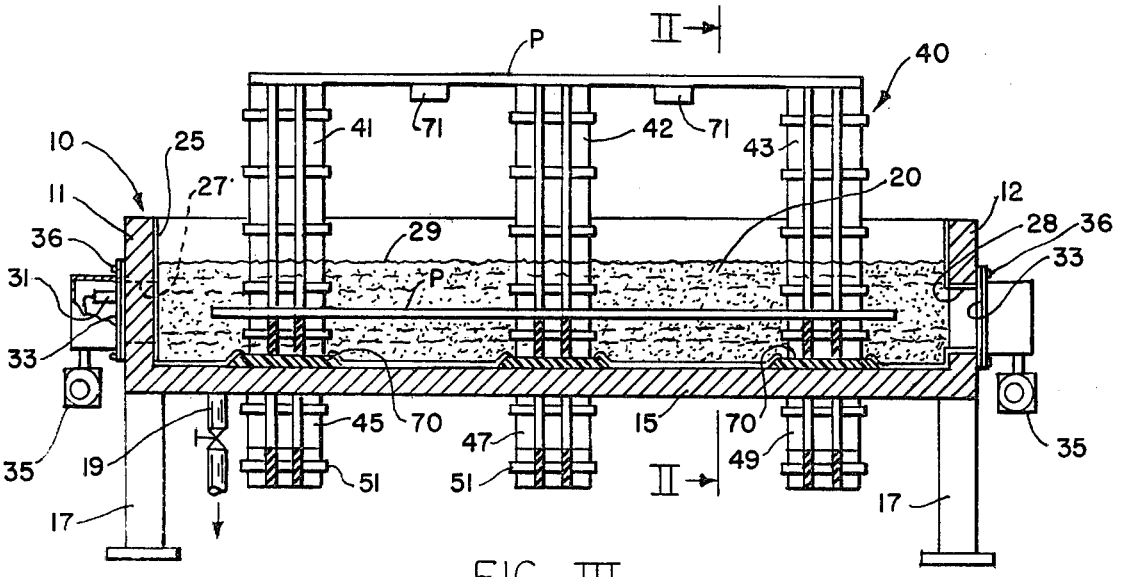
FIG. III
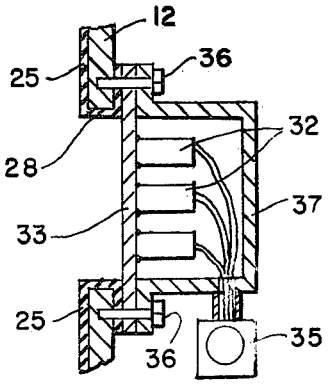
FIG. IV

SONIC TREATING APPARATUS

BACKGROUND OF THE INVENTION

The sonic treatment of sheet material immersed in a treating liquid for its cleaning, pickling, phosphating, or the like, is known; however, usually the sonic vibrations have been directed against and relatively close to the large flat surfaces of the sheet material, such as disclosed in the following U.S. patents:

| Name | No. | Date | Class |
|---|---|---|---|
| Engelhardt | 2,894,860 | July 14, 1959 | 134/1 |
| Osterman, Jr. et al | 3,066,084 | November 17, 1962 | 134/1 |
| Tardoskegyi | 3,123,084 | March 3, 1964 | 134/1 |
| Sasaki | 3,240,963 | March 15, 1966 | 134/1 |

Thus, when larger sheets were to be treated, more sonic vibrators were used to cover their larger surface.

Nevertheless, FIGS. 7 and 8 of Massa U.S. Pat. No. 2,702,260 issued Feb. 15, 1955 and found in U.S. Class 134 subclass 1 does show sonic vibrators along the edges of a shallow tank for treating a continuous web, but no means for supporting and directing the web or even treating separate successive sheets are shown.

If the material to be sonically and liquid-treated is not a web, but separate pieces, the pieces are usually suspended in a tank and/or given a batch-type of treatment, the tanks for which are relatively deep and thus require a large volume of treating liquid, such as shown in the following U.S. patents:

| Name | No. | Date | Class |
|---|---|---|---|
| Hightower et al | 3,033,710 | May 8, 1962 | 134/1 |
| Mobius et al | 3,449,163 | June 10, 1969 | 134/1 |
| Jacke et al | 2,950,725 | August 30, 1960 | 134/1 |
| Brech | 3,596,883 | August 3, 1971 | 134/184 |

Since it has been considered more effective to place the sonic vibrators as close to the material being treated as possible, the vibrators often have been placed in the treating liquid in the tanks, including their necessary electrical connections, all of which requires expensive protective shielding. Although vibrators have been placed outside of tanks, they are usually placed in false bottoms in the tanks as disclosed in the above mentioned Tardoskegyi and Jacke et al patents, or the vibrators have been placed on the bottoms of the tanks as disclosed in the following U.S. patents:

| Name | No. | Date | Class |
|---|---|---|---|
| Camp | 3,058,014 | October 9, 1962 | 310/8.7 |
| Cook | 3,371,233 | February 27, 1968 | 310/8.1 |
| Brech | 3,596,883 | August 3, 1971 | 134/184 |
| Morita | 3,730,489 | May 1, 1973 | 134/184 |

The use of conveyors which move through reactive liquids in treating tanks is also known, even in ultrasonic cleaning liquid tanks as shown in Branson U.S. Pat. No. 3,222,221 issued Dec. 7, 1965 found in Class 134 subclass 1, but the conveyors do not pass through the sonically vibrated liquid. Also a conveyor resistant to treating liquid is shown in Millard U.S. Pat. No. 1,656,528 issued Jan. 17, 1928 found in Class 134 subclass 124, but such a conveyor is not for or used in combination with sonic treating.

Several of the above mentioned patents, such as Engelhardt U.S. Pat. No. 2,894,860 issued July 14, 1959; Osterman, Jr. et al U.S. Pat. No. 3,066,084 issued Nov. 17, 1962 and Sasaki U.S. Pat. No. 3,240,963 issued Mar. 15, 1966 disclose the sonic treating of a web of sheet material from a coil, but no reference of record was found in which either sheets or webs from coils were supported during and in sonically vibrated liquids.

SUMMARY OF THE INVENTION

Generally speaking, the process or method of this invention comprises supporting and passing sheet material to be treated with their planes horizontal through a coplanar transversely horizontally sonically vibrating liquid, vibrated by vibrators along the parallel sides of the shallow tank containing the liquid. The sheet material may comprise a continuous relatively thin web or strip or may comprise individual separate sheets or plates, such as of metal or steel, which sheet material is to be cleaned in a pickling, phosphating, or solvent liquid solution. However, other liquid treating processes than cleaning may be improved by the process and apparatus of this invention.

A specific and preferred embodiment of an apparatus for carrying out this invention comprises a relatively shallow rectangular horizontal tank spaced from the floor such as by legs and filled with the treating liquid to a depth of preferably less than a foot. The liquid may be introduced into the tank through a duct from above the top of the tank and the tank bottom may be provided with a valved outlet duct for circulating, draining and/or changing the liquid in the tank. Temperature control means, including a heat exchanger, may be placed in the path of liquid circulated through the tank for maintaining its temperature.

There are provided along the two opposite parallel shallow sides of the tank, substantially the depth of the liquid in the tank, two series of sonic vibrator units bolted on transversely staggered openings in the sidewalls of the tank. These units each have a treating-liquid-resistant sonic vibration transmitting plate, such as of stainless steel or Monel metal, which is bolted over the holes and against the outside of the sidewalls. The sonic vibrators are integrally attached to the outside of these plates for transmitting their vibrations through these plates into and through the liquid in the tank forming a horizontally sonically vibrated treating liquid. Thus, the sonic vibrators are all outside of the tank and treating liquid in it, and their electrical operating and control connections are easily accessible and do not have to be shielded from any chemically reactive treating liquid.

A means for supporting and conveying the sheets to be treated horizontally through this horizontally sonic vibrating liquid from one end of the tank to the other, may comprise a plurality of parallel sprocket chains which are supported by skid strips along the bottom of the tank and suspended at their ends from sprocket wheel whose peripheries project above the upper edge of the ends of the tank. These sprocket wheels may be of a sufficient diameter so that the chains on their return reaches extend underneath the tank between the supporting legs for the tank. These sprocket wheels preferably are driven by a hydraulic motor, either connected directly to their shaft or by another sprocket or gear-driving mechanism. The sprocket chains are preferably made of a treating-liquid-resistant material, including plastic such as a high-molecular weight polyethylene.

Since the sonic vibrating layer of treating liquid materially increases the reactivity of the liquid on the sheet material being treated, the temperature, concentration, and time of passage of the sheet material through the liquid can be decreased correspondingly to obtain at least the same amount of and usually a better treating effect than can be obtained without sonic vibrations. Thus, if a corrosive acid, such as hydrochloric acid is employed for the pickling of steel sheets, the temperature of the treating liquid acid may be sufficiently low so that the danger from fumes thereof and loss of acid is materially reduced, as well as the energy required for maintaining an effective treating temperature. Furthermore, the concentration of the acid in the liquid also may be reduced, and unexpectedly the cleaning of the plates is improved above that which can be obtained even at higher temperatures and concentrations of acid.

OBJECTS AND ADVANTAGES

Accordingly, it is an object of this invention to produce a simple, effective, efficient, rapid, economic, anti-polluting, highly versatile, sonic-vibrated liquid treating apparatus for sheet material.

Another object is to produce such an apparatus which is continuous, uses less treating liquid, produces a cleaner or better treated product, operates at a lower temperature, requires less energy and power than previously known sonic vibrating treating liquid processes and apparati. Since it takes about 3.5 watts per cubic centimeter of liquid in order to do an adequate job of sonic vibrating, the less liquid employed, the less watts and power is required.

Another object is to clean separate metal sheets or a continuous web of metal by directing sonic vibrations along two opposite parallel sides of the sheet to remove bubbles and to loosen oxides and scale from its surface, as well as to remove sharp edges from the surface, thus producing a smoother sheet product.

More specifically it is an object of this invention to pickle steel sheets in a hydrochloric acid solution below about 170° F. with an acid concentration less than about 12% by weight at a rate of at least about 50 tons of steel per hour. The advantage of sonic pickling with hydrochloric acid instead of sulfuric acid is that one can treat at a lower temperature and thus less fumes escape. Usually to prevent fumes from escaping, less volatile sulfuric acid is used in a dipping process, but then this has the disadvantage of the disposal of the spent sulfuric acid, which is more difficult to regenerate than spent hydrochloric acid.

Another specific object is that by this process and apparatus a phosphate-treating of sheets can be performed effectively without spraying the phosphate on the steel, and thus avoid any clogging of the nozzles of the sprayers.

BRIEF DESCRIPTION OF THE VIEWS

The above mentioned and other features, objects and advantages, and manners of attaining them are described more specifically below by reference to embodiments of this invention shown in the accompanying drawings, wherein:

FIG. I is a schematic perspective view of an embodiment of a treating tank and conveyor for supporting and passing sheet material through a horizontal sonically vibrated liquid in the tank;

FIG. II is a slightly enlarged vertical section through the right end of the tank shown in FIG. I, or taken along line II—II of FIG. III, adapted for treating a continuous coil, web, or strip of material;

FIG. III is a further enlarged vertical cross-section taken along line III—III of FIG. II showing separate sheets of material passing through the tank and supported by the conveyor; and FIG. IV is a further enlarged vertical section through one of the sonic vibrator units bolted to the righthand sidewall of the tank shown in FIG. III.

DETAILED DESCRIPTION OF PREFERRED EMBODIMENTS

In the figures there is shown a shallow rectangular tank 10 having two longer parallel sides 11 and 12, two end walls 13 and 14, and a bottom 15. The tank 10 is provided with an interior rubber or other treating-liquid-resistant coating 25 and may also be provided with a cover 16 (see FIGS. II, III and IV) which may be removable. The tank 10 may be suspended above the floor by legs 17 between the floor and bottom 15 of the tank.

The treating liquid 20 may be introduced into the top of the tank through a valved duct such as 18 shown in FIG. I, and the bottom of the tank may be provided with one or more drain valved ducts 19. For maintaining the temperature of the liquid 20, it may be circulated from duct 19 to duct 18 through ducts 21 and 22 and a heat exchanger 23 by means of a circulating pump 24. These ducts, pump and heat exchanger are made of or lined with a treating liquid-resistant material. The heat exchanger may be heated by another fluid such as steam introduced therein through a valved duct 26.

Along opposite parallel sides of the tank 10 in the walls 11 and 12 are provided a series of sonic vibrators 31 and 32, respectively, integrally mounted to treating liquid-resistant metal plates 33 (see FIGS. III and IV), such as of stainless steel or Monel metal. These plates 33 cover the apertures 27 and 28 in sidewalls 11 and 12, respectively, of the tank 10. These apertures 27 and 28 are preferably located close to the bottom 15 and lower edges of the sidewalls 11 and 12 and spaced inwardly from each end wall 13 and 14 of the tank so that the apertures 27 and 28 are staggered with respect to each other on opposite sides of the tank. The treating liquid 20 has its upper level 29 just above the top of apertures 27 and 28 so that the vibrators 31 and 32 produce horizontally vibrating liquid particles across the tank 10. The sonic vibrators 31 and 32 are connected via electrical manifold conduits 35 (see FIG. I) to a control panel box 36 supplied by electrical energy through a conduit 37. These sonic vibrators 31 and 32 are preset to vibrate at a frequency between about 20 and 27 kilohertz, and preferably at about 25 kilohertz. One of the advantages of this invention is that all of the electrical connections are outside of the tank 10 and of the treating liquid 20, and therefore do not have to be fluid-insulated and shielded to be resistant to this treating liquid. Furthermore, since all of the electrically operated sonic vibrators 31 and 32 are outside the tank, they may be easily replaced and repaired or removed by removing the bolts 36 that connect their flanged housings 37 and plates 33 to the sidewalls 11 and 12 of the tank 10 and against a gasket which may be an extension of the rubber lining coating 25 of the inside of the tank 10 surrounding the apertures 27 and 28 (see FIG. IV).

For supporting, passing, conveying and/or conducting the sheet material P or S through the horizontally vibrating treating liquid 20 in the tank 10, there is provided a conveyor means 40 comprising a plurality of parallel sprocket chains 41, 42 and 43 which pass around large sprocket wheels 45, 47, 49 adjacent the end wall 13 of the tank, and correspondingly respectively aligned sprocket wheels 44, 46, 48 adjacent the opposite end wall 14. The diameter of these wheels is preferably larger than the height of the walls 13 and 14 of the tank 10, so that the return reaches of the sprocket chains 41, 42 and 43 may pass underneath the tank 10 in the space provided by the legs 17 between the tank's bottom 15 and the floor. The links of these sprocket chains 41, 42 and 43, and preferably also the sprocket wheels 44 through 49 are made of a material which resists the treating solution 20, such as a high molecular weight polyethylene plastic. The links are pinned together by plastic pins 51 which engage corresponding pins 52 on the sprocket wheels 44 through 49 (see FIGS. II and III) for positively moving the chains 41, 42 and 43. The parallel shafts 53 and 54 at opposite ends of the tank 10, to which the sprocket wheels 45, 47 and 49 and sprocket wheels 44, 46 and 48 are respectively keyed, may be supported by brackets 55. Preferably shaft 54 is driven by a hydraulic motor 60 (see FIG. I) having inlet and outlet ducts 61 and 62, respectively. It is advantageous, however, that the speed of the shaft 54 and conveyor 40 be infinitely variable in order to provide for different treating times, depending upon the concentration and temperature of the treating liquid, as well as the type of sheet material P or S being treated. Thus, the speed of the hydraulic motor 60 may be varied infinitely by controlling valve 66 in its input duct 61.

There also may be provided the ends of the conveyor 40, supporting bars 71 and 72 for the sheet material fed to and from the conveyor 40. This is particularly advantageous for supporting and guiding the separate sheets or plates P as shown in FIGS. I and III through the sonic vibrated liquid 20. However, a web of sheet material S as shown in FIG. II from a coil C also may be fed, supported and guided by the conveyor 40, in which case the end supporting bars 71 and 72 may not be required. In order to prevent too much sagging of the reaches of the conveyor chains 41, 42 and 43 in the tank 10, there are provided supporting means such as skids 70 located along the bottom of the tank 10 made on a treating-liquid-resistant material, such as a frictionless-type plastic. (See FIGS. II and III)

It is to be clearly understood that other types of conveyor means instead of the treating-liquid-resistant sprocket chains 41, 42 and 43 may be provided for supporting and moving or passing the sheets P and S through the horizontally sonic vibrating liquid 20 without departing from the scope of this invention. Furthermore, if sprocket chains such as 41, 42 and 43 are employed, instead of going around large single sprocket wheels 44 through 49 at each end of the tank 10, there may be provided a pair of vertically spaced wheels of smaller diameter for each large single sprocket wheel, one smaller wheel projecting slightly above the top and the other slightly below the bottom of the tank 10.

EXAMPLE I

Separate hot rolled high tensile steel plates 27¼" wide, 88" long, 0.121" thick, and weighing 81 pounds each were pickled in a shallow tank or vat, similar to tank 10 in FIG. 1, which tank had a width of 10', length of 24' and a depth of about 1'. It was filled to a depth of about 8" with 8% by weight aqueous hydrochloric acid solution which was maintained at a temperature of about 165° F. by circulation through a steam-heated heat exchanger. Three parallel plastic sprocket chains transported these steel plates through the hydrochloric acid pickling solution which chains were operated at a speed of 25' per minute. This speed enabled 14 sheets per minute to be fed through the pickling vat, which is equivalent to about 34 tons of steel per hour. The dip length of the conveyor in the pickling acid was about 16½' so that the dip time for each sheet averaged about 40 seconds. The ultrasonic vibrator units along each side of the tank, each produced 500 watts of energy during the pickling of these sheets, and seven of these units were placed along each side of the tank. The frequency of these ultrasonic vibrators was 25 kilohertz. The resulting pickled sheets were cleaner and more rapidly pickled than was possible with the prior art dipping of the sheets in a sulfuric acid solution or bath.

It has been found that by the use of the above described apparatus that the concentration of the acid may vary between about 6% and 12% by weight and preferably about 8% by weight, and that the temperature of the hydrochloric acid treating solution can vary between about 110° and 170° F. and preferably between about 150° and 165° F.

It was also found that if a piece of metal foil were suspended vertically and transversely of the horizontal vibrations in the treating liquid in the tank at the center line between the opposite parallel rows of supersonic vibrators, that the foil, even though it was 5' from the vibrators, was pierced with holes by vibrating horizontal particles in the treating liquid.

EXAMPLE II

Similar steel sheets to those described in Example I above were treated in the same tank in a 3% by weight aqueous solution of zinc phosphate.

If the sonic vibrators were not operated, it took about one minute for the plates in the solution to get a coating thickness of 400 milligrams per square foot at a temperature of 160° F. However, when the ultrasonic vibrators were operated, it not only cleaned the steel plates but only took 30 seconds to produce the same coating and at a temperature of between about 130° and 145° F. Thus, the dwell time was reduced by half and the temperature was reduced between 15° and 30° F., thereby materially saving on the energy applied, and in addition the quality of the product was improved.

The temperature for the phosphate coating steel plates can be between about 160° and 200° F., and the time of treatment can be reduced as low as about 21 seconds.

It also is to be understood that the treating solution in the tank, although it is primarily used for cleaning sheet material, may be for other treating processes wherein intimate contact between the treating liquid and the surface of the sheet P or S is required, which contact is augmented by sonic vibrations. The important feature of this invention is that the sonic vibrators along the edge of the sheet provide sufficient vibration throughout the full sheet and the liquid 20 so as to clean relatively wide sheets P or webs S.

While there is described above the principles of this invention in connection with specific apparatus and methods of operating the same, it is to be clearly understood that this description is made only by way of example and not as a limitation to the scope of this invention.

We claim:

1. A sonic treating apparatus for sheet material comprising:

(A) a shallow tank of treating liquid having parallel sidewalls, (B) a plurality of sonic vibrators mounted on and outside said parallel sidewalls to produce a horizontally vibrating liquid in said tank, and (C) a plastic sprocket chain conveyor resistant to said treating liquid for moving and supporting continuously the sheet material to be treated in said tank horizontally through and transversely to said horizontally vibrating liquid in said tank between said sonic vibrators, with opposite edges of said sheet being adjacent said parallel sidewalls and said vibrators.

2. An apparatus according to claim 1 wherein said tank is rectangular.

3. An apparatus according to claim 1 wherein said treating liquid is an acid.

4. An apparatus according to claim 3 wherein said acid is hydrochloric acid.

5. An apparatus according to claim 1 wherein said treating apparatus is a pickling apparatus and said liquid is hydrochloric acid in a concentration between about 6% and 12% by weight at a temperature between about 110° and 170° F.

6. A pickling apparatus according to claim 5 wherein said hydrochloric acid has a concentration of about 8% by weight and the temperature of said acid in said tank is between about 150° and 165° F.

7. An apparatus according to claim 1 wherein said tank is lined with a corrosive-resistant material.

8. An apparatus according to claim 7 wherein said tank is rubber-lined.

9. An apparatus according to claim 1 wherein said sidewalls are provided with apertures and wherein said apertures are covered by corrosive-resistant metal plates integrally mounting said sonic vibrators.

10. An apparatus according to claim 9 wherein said metal plates are Monel metal.

11. An apparatus according to claim 1 wherein said plurality of vibrators and their electrical connections are mounted outside said tank.

12. An apparatus according to claim 1 wherein said conveyor comprises a plurality of plastic sprocket chains for supporting and moving said sheet material through said liquid in said tank.

13. An apparatus according to claim 12 wherein the inside bottom of said tank has low coefficient of friction means for supporting said chains.

14. An apparatus according to claim 12 wherein said chains are driven by sprocket wheels of a diameter greater than the depth of the tank so that the return flights of the chains pass under said tank.

15. An apparatus according to claim 1 wherein said conveyor is driven by a variable-speed motor drive.

16. An apparatus according to claim 15 wherein said variable-speed motor drive comprises a hydraulic motor.

17. An apparatus according to claim 1 wherein said sonic vibrators vibrate at a frequency between about 20 and 27 kilohertz.

18. An apparatus according to claim 16 wherein said sonic vibrations vibrate at a frequency of about 25 kilohertz.

* * * * *

UNITED STATES PATENT AND TRADEMARK OFFICE

CERTIFICATE OF CORRECTION

PATENT NO. : 4,311,157

DATED : January 19, 1982

INVENTOR(S) : Duncan B. Jubenville et al

It is certified that error appears in the above-identified patent and that said Letters Patent are hereby corrected as shown below:

Column 2, line 61, change "wheel" to - - wheels - -.

Column 5, line 35, after "provided" insert - - adjacent - - .

Signed and Sealed this

*Eighth* Day of *June 1982*

|SEAL|

*Attest:*

GERALD J. MOSSINGHOFF

*Attesting Officer*

*Commissioner of Patents and Trademarks*